United States Patent [19]

Mackinnon

[11] 4,073,301

[45] Feb. 14, 1978

[54] LIQUID TREATMENT OF SMALL ARTICLES

[75] Inventor: Robert Ian Mackinnon, Tupsley, England

[73] Assignee: Huntington Alloys, Inc., Huntington, W. Va.

[21] Appl. No.: 723,522

[22] Filed: Sept. 15, 1976

[30] Foreign Application Priority Data

Sept. 26, 1975 United Kingdom ..... 39560/75

[51] Int. Cl.[2] ..... B08B 3/02

[52] U.S. Cl. ..... 134/65; 134/109

[58] Field of Search ..... 134/65, 109, 132

[56] References Cited

U.S. PATENT DOCUMENTS

| | | | |
|---|---|---|---|
| 1,251,073 | 12/1917 | Maloney | 134/65 |
| 2,427,388 | 9/1947 | Curran | 134/132 |
| 2,696,821 | 12/1954 | Streets | 134/65 |
| 3,610,260 | 10/1971 | Kearney | 134/109 X |

FOREIGN PATENT DOCUMENTS

| | | | |
|---|---|---|---|
| 648,473 | 11/1964 | Belgium | 134/65 |

*Primary Examiner*—Robert L. Bleutge

*Attorney, Agent, or Firm*—George N. Ziegler; Ewan C. MacQueen

[57] ABSTRACT

Apparatus for continuously conducting processes of cleaning, pickling or other fluid treatment of small articles such as metal turnings, cuttings, tags, bolts or coin blanks has rotating inclined drum carrying internal scroll with interruptions for providing countercurrent flows of treatment fluid flowing downward and articles moving upward; special embodiments provide for multiple stage treatments passing through plurality of coaxially rotating drums.

7 Claims, 1 Drawing Figure

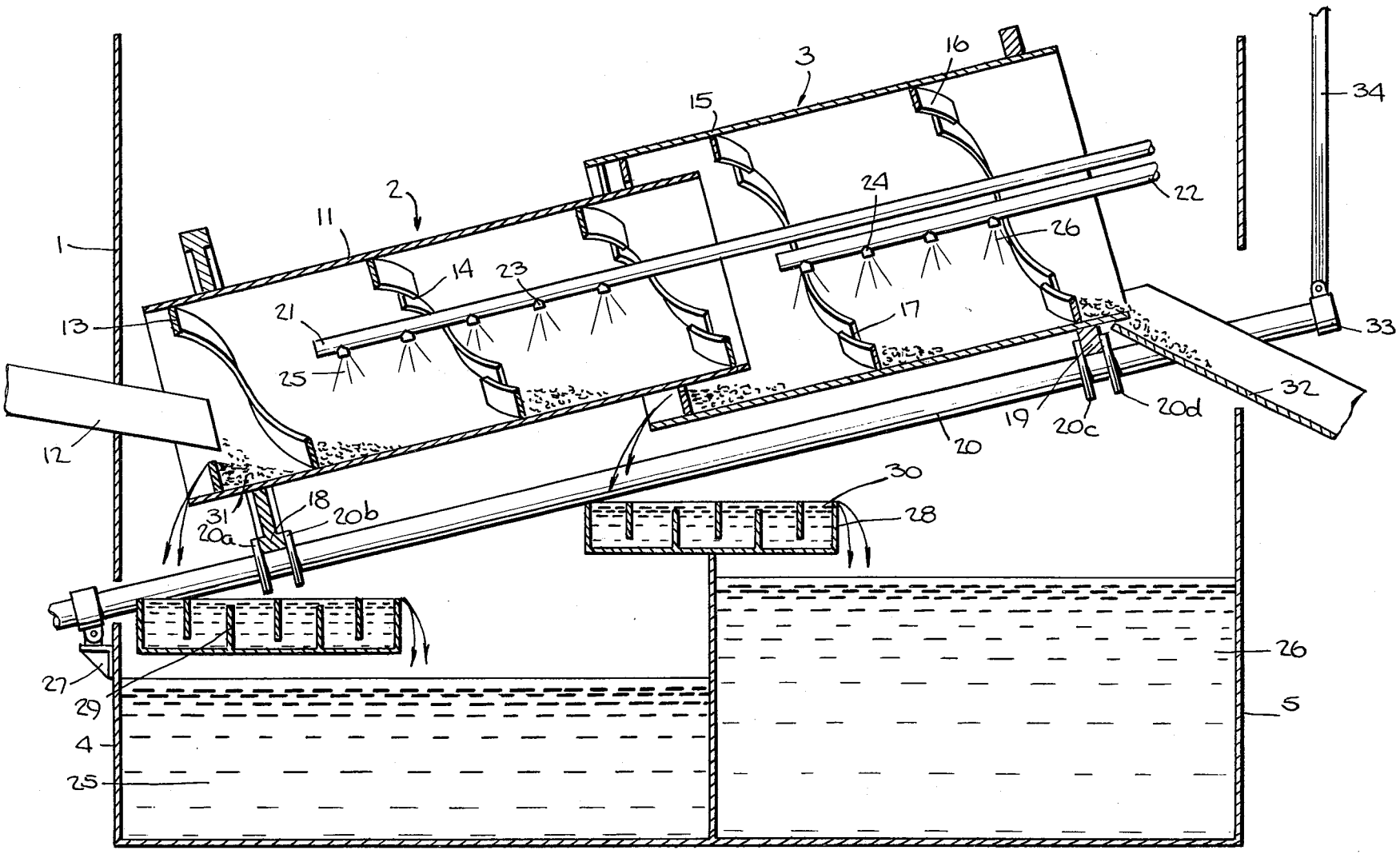
34
33
32
26
5
22
20d
20c
19
26
16
20
17
24
28
30
3
15
23
14
2
11
21
25
18
20b
31
20a
1
13
12
27
29
4
25

LIQUID TREATMENT OF SMALL ARTICLES

The present invention relates to apparatus for treating small articles with liquids on a continuous basis, particularly for the cleaning or pickling of small metal parts or of metal swarf.

Metal swarf such as turnings or cuttings are contaminated by dirt and grease and cannot be remelted unless first cleaned. Similarly many small articles such as nuts, bolts, electrical connectors and tags, and coin blanks require treatment such as washing, brightening or pickling after manufacture.

Apparatus commonly in use for washing small articles, metal swarf and the like, consists of a rotatable cylindrical drum having a continuous internal spiral to operate as an Archimedes screw so that when the drum is rotated, the swarf is transported from the feed end of the drum to the discharge end. The drum is perforated in two zones, the first, comprising a washing zone, is located at the feed end and is provided with nozzles through which washing liquid is sprayed; the second, comprising a rinsing zone, is located at the discharge end and is provided with nozzles through which rinsing water is sprayed. The drum assembly is located above two sump tanks, one containing the heated washing liquid with detergent or alkali and the other containing rinsing water. In use, the swarf is fed through the drum and is sprayed with washing liquid above the washing sump so that oil is washed from the swarf and runs through the perforations in the wall of the drum to be collected in the washing sump for recirculation. As the washed swarf passes along the spiral it moves into the rinsing zone and is sprayed by rinsing water which runs through the perforations into the rinse sump. Although this design has been in commercial use for many years it has serious disadvantages in that the perforations readily become blocked with swarf being cleaned and this causes the wash liquid to flood into, and contaminate, the rinse sump. A further disadvantage is that the washing and rinsing zones may only constitute a small proportion of the overall length of the drum in order that the risk of intermixing is minimized. This is, of course, uneconomic in terms of space and utilization and complicates collection of the washing and rinsing liquids.

Pickling of coin blanks, for example, is performed with batches treated discontinuously in a rotary barrel where, after pickling, the pickling liquid is subsequently drained away and replaced by a washing solution and then rinsing water.

There has now been discovered apparatus for continuous liquid treatment of small articles which is beneficial to overcoming flooding problems and has advantages for multistage continuous treatment processes.

An object of the present invention is to provide apparatus for continuous liquid treatment of small articles.

Other objects and advantages of the invention will become apparent from the following description taken in conjunction with the accompanying drawing which shows a longitudinal cross-sectional, and partially elevational, view of an embodiment of liquid treatment apparatus of the invention.

The present invention contemplates liquid treatment apparatus having a drum rotatably mounted with its axis inclined to the horizontal and the interior of the drum having an internal scroll which has one or more interruptions enabling passage of liquid along the drum length, and including means for supplying recirculating treatment liquid to one or more positions within the drum whereby, in use, when the drum is rotated articles fed to the lower end of the drum are elevated to and discharged from the upper end whilst the treatment liquid supplied to the drum flows countercurrent to the articles through the interruptions in the scroll, said interruptions being restricted sufficiently to bar passage of the articles. Preferably the drum is cylindrical. For multiple stage treatments a plurality of drums are used and means are provided enabling articles discharged from the upper end of one drum to be fed to the lower end of the next drum.

In an advantageous embodiment having more than one drum, the drums are mounted in line coaxially, the diameter of at least a portion of each successive drum being larger than that of its predecessor and each located with its lower end overlapping the top end of the preceding drum.

The internal scroll is interrupted at one or more positions along its length so that the treatment liquid does not build up but flows under gravity down through the interruption countercurrent to the articles to be treated. It has been found that the most advantageous flow is obtained by arranging that the leading and trailing edges of the scroll overlap and are offset from each other at the point of the interruption so that articles being treated are deflected across the interruption and are not allowed to pass through the interruption and move back down the drum.

It has been found that improved treatment may be achieved by increasing the depth of the scroll from the lower end of the drum to the top end.

In certain specially effective embodiments of the invention the lower few turns of the scroll are continuous, but thereafter the scroll is interrupted at least about once every turn; moreover the pitch of the scroll is increased after the lower two turns. In use this special embodiment allows a liquid build-up in the lower turns of the scroll and liquid may overflow from one turn of the scroll to the next. Thus, during the initial period of treatment the material being treated is totally immersed. Moreover, this embodiment safeguards against risks of fine particles of the treated material being swept away.

When multiple stage treatments are used it is advantageous to locate the tanks vertically below the lower end of each drum. The tanks are separated from each other in order to inhibit risk of cross contamination of treatment liquids. The used treatment liquid draining from the bottom of the drum is collected in the tank and recirculated, for example, via valves and pumps to means for supplying treatment liquid within the drum. Preferably, the liquid is supplied by means of a plurality of spray nozzles located axially within the drum.

When the treatment liquids are returned directly to the tanks there can be a build-up of fine particles, overflowing from the tank, on the base of the tank, and the build-up is difficult to remove without stopping the treatment. These particles may also cause blockages of the spray nozzles and valves during recirculation. The tanks are provided, desirably, with separators allowing the collection and removal of any material which is washed into them. In a preferred embodiment of the invention the liquid draining from the drum is passed into a separator wherein the liquid is caused to flow alternately over and under weir plates and baffle plates prior to collection in the tank. Fine particles of material are retained in the separator and are readily recovered.

Apparatus of the present invention is particularly suitable for washing nickel, iron, or cobalt-based alloy swarf. However the swarf should be in such a form that it does not conglomerate into tight bundles during treatment. In some cases, e.g. brass turnings, some pretreatment may be necessary to convert it to a more suitable form.

It is advantageous for apparatus of the present invention to have means for independently varying the speed of rotation of the drum, its angle of inclination to the horizontal, and the direction at which recirculating treatment liquid is supplied to the drum. By varying these parameters optimum conditions for different treatments and articles may be readily established.

In apparatus of the present invention used for washing, the drums may conveniently be made of mild steel. For pickling and other treatments using corrosive liquids, however, the drums should be made of corrosion-resistant alloys compatible with the particular treatment fluid to be used.

In order that the invention may be more fully understood, an embodiment of apparatus of the present invention is described, by way of example only, with reference to the accompanying drawing which shows a swarf washing apparatus in part cross section.

The apparatus has housing 1 within which are mounted washing unit 2 and rinsing unit 3, the base of housing 1 being divided into two sump tanks 4 and 5 to hold wash liquid and rinse water, respectively.

The washing unit 2 consists of cylindrical wash drum 11 inclined to the horizontal, having a cylindrical feed pipe 12 leading in through housing 1 to the lower end of the drum 11. The cylindrical drum 11 has internal scroll 13 with interruptions 14 along its length, the leading and trailing edges of the scroll being overlapped and offset apart from each other at the place of each interruption. The wash drum 11 is rigidly connected to the cylindrical drum 15 of the rinsing unit 3, the drum 15 having a larger diameter than the wash drum 11 and being located coaxially and surrounding and overlapping with the end portion of wash drum 11. The rinse drum 15 also has an internal scroll 16 with interruptions 17 along its length as in the wash drum 11. Wash drum 11 and rinse drum 15 have external projections 11A and 15A, respectively, which hold rollers 18 and 19 that ride on two mutually parallel spaced-apart shafts that are below, parallel to the drum axis, one being shown as shaft 20 with roller flanges 20A, 20B, 20C and 20D and the other being the same but not shown due to location above the plane of the drawing. It is to be understood accordingly that the drum assembly, 11 and 15, is supported by the two shafts. The shafts are driven rotationally by means of a chain drive by a variable speed, geared, electric motor unit, not shown, so that the drums may be rotated together about their common axis in a forward or reverse direction.

Two pipes 21, 22 run axially through the cylindrical drums 11, 15 each having nozzles, 23 and 24, located at intervals along the pipe length. The wash pipe 21 is fed from a pump unit, not shown, with wash liquid 25 recirculated, in use, from the wash sump tank 4. Similarly rinse pipe 22 is fed with rinse liquid 26 from the rinse sump tank 5.

Separators 27 and 28 are located vertically below the lower ends of wash drum 11 and rinse drum 15 respectively. The separators 27 and 28, each readily removable for cleaning, comprise arrays of weir plates 29 and baffle plates 30 arranged for liquid admitted at one side of the separator to flow alternately over weir and under baffle plates, solid particles settling in the weir, the separated liquid flowing over the opposite side of the separator and being collected in the sump tanks 4 and 5 respectively.

In use, swarf 31 to be cleaned, is admitted by the feed pipe 12 to the wash drum 11 which is being rotated about its axis. The rotation causes the swarf to be moved upwards along the drum by means of the scroll, which acts as an Archimedes screw, and the swarf is sprayed with wash spray 25 jetted from nozzles 23 on the wash pipe 21. After washing the swarf, the wash liquid flows under gravity (countercurrent to the swarf being washed and moving upward) descending down through the interruptions in the scroll and dropping from the wash drum, and is collected in separator 27. The wash liquid flows over weir plates 29 and under baffle plates 30, particles being accumulated in the weir, and separated liquid overflowing the side of the separator to be collected in the sump tank 4. The sump tank is provided with drain valve, water filling and ball float valves, and an injection valve for the addition of detergent or alkali, not shown, to enable the wash liquid to be recirculated via a pump for spraying from the nozzles 23 of the wash pipe 21.

As the swarf being washed moves up the scroll to an interruption, it is deflected across the interruption and continues to move upwards whilst the wash liquid runs down through the interruption. When the swarf reaches the top end of the wash drum 11 it spills over into rinse drum 15 and is moved upwards along the drum by means of the scroll 16, and is sprayed with a rinse spray 26 jetted from the nozzles 24 of the rinse pipe 22.

After rinsing, the rinse liquid flows under gravity, and countercurrent to the swarf being rinsed, and is collected in separator 28, there separated from solid particles, and then drops back into rinse sump 5 for recirculation. The interruptions 17 in the scroll 16 act as in the washing unit, and the washed and rinsed swarf then overflows from the top end of rinsing drum 3 into output chute 32 from which it is collected, or passed continuously for drying. Movable support 34, attached to a vertical movement actuator, e.g., air cylinder or rack-and-pinion (not shown), enables raising or lowering bearing 33 to change the inclination angle of the drum axis.

Preferably, the sump tanks are provided with heaters and a wash liquid of a hot detergent solution and rinse liquid of hot water are used. Alternatively, a hot alkaline solution may be used for washing. In a typical apparatus of the invention, sump tanks 4 and 5 each accommodate about 800 gallons of liquid: wash drum 11 is a mild steel cylinder of about 24 inches diameter; and rinse drum 15 is a mild steel cylinder of about 30 inches diameter. Rotation of the drums at from about 2 to 10 revolutions per minute allows about 500 kg/hr of nickel/chromium alloy swarf to be washed and rinsed without the flooding difficulties.

For washing very fine swarf the scroll may be of increasing depth from the lower end to the upper end of one of each drum. These, and other modifications and variations as will be apparent to those experienced in the art are also within the scope of the present invention.

The apparatus described may also be used for washing small articles such as nuts, bolts, electrical connectors and tags and the like without modification. Moreover, apparatus of the present invention may also be used to remove the swarf powder and grease adhering to mass-produced articles such as small components of internal combustion engines, and for the pickling and other treatments of small metal articles such as coin blanks.

I claim:

1. Apparatus for treating small articles with liquid comprising an imperforate drum mounted to rotate around an axis inclined to the horizontal, a scroll attached to the interior of the drum and having at least one interruption across the length of the scroll and extending the full depth of the scroll and dividing the scroll into portions, the outer edge of each portion being continuously attached to the interior of the drum and the inner edge being unobstructed to flow of fluid over the edge at places where fluid collects to a depth greater than the depth of the scroll and the leading and trailing ends of each portion of the scroll being overlapped and offset from each other at the place of the interruption sufficiently to provide that articles being treated are deflected across the interruption and prevented from moving back down the drum, means for introducing a liquid into the drum and means for recirculating the treatment liquid out of and again into the drum.

2. Apparatus having a plurality of drums as set forth in claim 1 mounted in coaxial alignment with a portion of each upwardly successive drum overlapping the upper exterior of the lower preceding drum.

3. Apparatus as set forth in claim 1 wherein the depth of the scroll is increased from the lower end to the upper end of the scroll.

4. Apparatus as set forth in claim 1 wherein the lower two turns of the scroll are continuous and thereafter the scroll is interrupted at least about once every turn.

5. Apparatus as set forth in claim 1 wherein the pitch of the scroll is increased after the first two turns.

6. Apparatus as set forth in claim 1 having means for varying the inclination of the drum axis to the horizontal.

7. Apparatus as set forth in claim 1 having a separator comprising an array of weir and baffle plates arranged for liquid from the drum to be admitted at one side of the separator and flow alternately over weir and under baffle plates to provide for settling of relatively dense material in the weir and recovering metallic fine material from the recirculating treatment fluid.

* * * * *